United States Patent [19]

Morimoto et al.

[11] 4,162,422

[45] Jul. 24, 1979

[54] COMPOSITE DIGITAL AND ANALOGUE FLUORESCENT DISPLAY PANEL DEVICE

[75] Inventors: Kiyoshi Morimoto; Akira Harada, both of Mobara, Japan

[73] Assignee: Futaba Denshi Kogyo K.K., Chiba, Japan

[21] Appl. No.: 944,350

[22] Filed: Sep. 21, 1978

Related U.S. Application Data

[63] Continuation of Ser. No. 737,168, Oct. 29, 1976, abandoned.

[30] Foreign Application Priority Data

Oct. 31, 1975 [JP] Japan ..... 50-130542

[51] Int. Cl.[2] ..... H01J 63/02; H01J 63/06

[52] U.S. Cl. ..... 313/496; 313/513

[58] Field of Search ..... 313/496, 497, 510, 517, 313/519, 513

[56] References Cited

U.S. PATENT DOCUMENTS

| | | | |
|---|---|---|---|
| 3,325,664 | 6/1967 | Buck et al. | 313/510 |
| 3,343,155 | 9/1967 | Pahlavan | 313/510 X |
| 3,573,532 | 4/1971 | Boucher | 313/510 X |
| 3,893,101 | 6/1974 | Glaser | 313/519 X |
| 4,023,876 | 5/1977 | Fukunaga et al. | 313/497 X |

*Primary Examiner*—Palmer C. Demeo

*Attorney, Agent, or Firm*—Oblon, Fisher, Spivak, McClelland & Maier

[57] ABSTRACT

A fluorescent display panel device comprising a casing formed of a base plate and a cover plate bonded airtightly together, a digital display section provided on the base plate and adapted to selectively and digitally display multi-column characters, figures, symbols and the like utilizing light emission of fluorescent substance, and an analog display section provided on the base plate adapted to selectively perform dot-shaped and/or bar-shaped analog display utilizing dot anodes linearly provided and having fluorescent layers thereon.

4 Claims, 3 Drawing Figures

COMPOSITE DIGITAL AND ANALOGUE FLUORESCENT DISPLAY PANEL DEVICE

This is a continuation of application Ser. No. 737,168, filed Oct. 29, 1976, and now abandoned.

BACKGROUND OF THE INVENTION

1. Field of the Invention

The present invention relates to a flat-plate type composite fluorescent display panel device (hereinafter referred to as a display panel) suitable for use, for instance, in various display panels in a vehicle.

2. Description of the Prior Art

Generally, a display device using fluorescent substance can perform various kinds of digital display by utilizing light emission from the fluorescent substance excited by bombardment of thermions emitted from the cathode, and therefore can obtain very clear fluorescent display comfortable to observe. As a result, such a display device is now widely used for various kinds of electronic desk calculators, electronic equipment, etc. However, such a conventional fluorescent display device can apply only to digital display for multi-column characters, figures, symbols, etc. and cannot apply to analog display for ratio, position, etc. In the case of analog display for ratio, position, etc., heretofore used were meters, a number of indicating lamps provided side by side, etc. However, in this case, the position and method of installation, power consumption, etc., posed many problems. Especially when analog display and digital display were simultaneously required, devices must be provided separately for digital display and analog display, and therefore there were many problems in terms of space, power consumption, appearance, etc.

SUMMARY OF THE INVENTION

Therefore, it is the primary object of the present invention to eliminate the above-mentioned disadvantages and to provide a novel fluorescent display panel device which can simultaneously perform both digital display and analog display in a clear and legible manner.

According to the present invention, there is provided a display panel comprising a casing composed of a base plate and a cover plate bonded together, a digital display section provided on the base plate and adapted to selectively and digitally display multi-column characters, figures, symbols, etc. utilizing fluorescent substance, and an analog display section provided on the base plate and adapted to selectively perform analog display utilizing dot anodes linearly provided and having fluorescent layers thereon.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
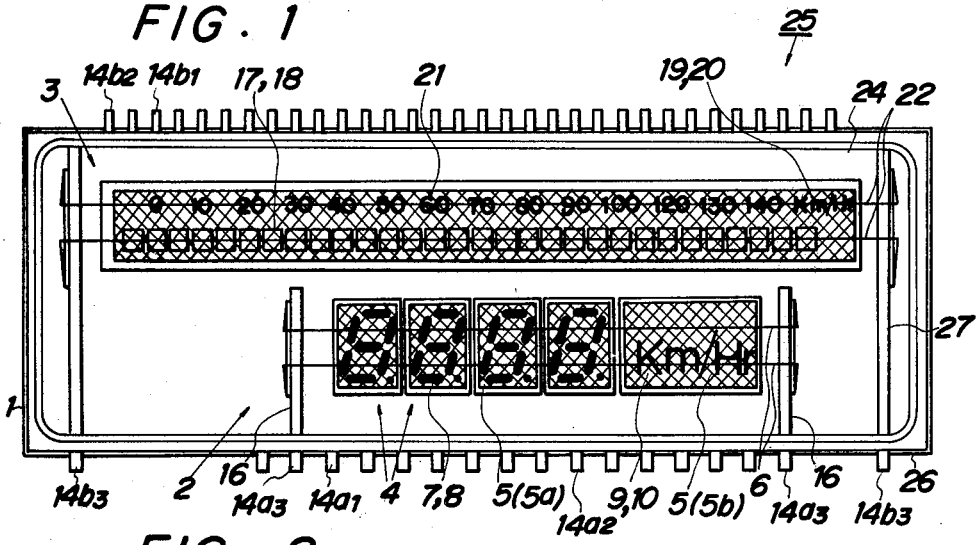
FIG. 1 is a plan view of a display panel according to one embodiment of the present invention.
Figure 2:
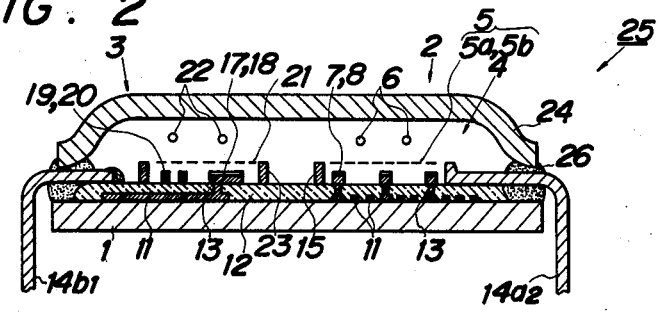
FIG. 2 is a sectional view of the display panel shown in FIG. 1.

Referring now to the drawings, wherein like reference numerals designate identical or corresponding parts throughout the several views, and more particularly to FIGS. 1 and 2 thereof, reference numeral 1 designates a base plate made of insulation material such as glass and ceramics. Reference numerals 2 and 3 designate a digital display section and an analog display section, respectively, arranged on the same upper surface of the base plate 1.

The digital display section 2 consists of a plurality of pattern display sections 4 provided side by side, a control electrode 5(5*a* and 5*b*) provided above and opposite to each pattern display section 4, and cathode 6 provided over and opposite to the pattern display sections 5 and the control electrodes 5 (5*a* and 5*b*).

Each of the pattern display sections 4 consists of a group of a plurality of segment anodes 8 each having a fluorescent layer 7 thereon, said group being so formed that it can selectively display a plurality of characters, figures or the like (FIG. 1 shows a pattern with letter 8 in addition to a point), and of pattern anodes 10 each having a fluorescent layer 9 thereon and disposed to represent a unit or the like of a figure displayed by the segment anodes 8. The pattern display sections or columns 4 are provided on the base plate 1 in a laminated manner with a wiring film layer 11 and an insulating film layer 12 therebetween. The wiring film layer 11 electrically connects the corresponding common segment anodes 8 and or pattern anodes 10 of each column 4 through connection holes 13 provided in the insulating layer 12 and, in addition, it is electrically connected to each of anode terminal lead-in wires $14a_1$ introduced from the outside.

The control electrodes 5 (5*a* and 5*b*) are provided for the respective pattern display sections or columns 4 and control or accelerate electrons emitted from the cathode 5 toward the groups of segment anodes 8 and pattern anodes 10 of the pattern display sections 4. In addition, the control electrodes 5 (5*a* and 5*b*) are formed, for instance, of fine meshes in order to clearly observe the fluorescent display of the segment electrodes 8 and pattern electrodes 10 from the above, and are fixed at predetermined positions through grid supports 15 and are connected to each of grid terminal lead-in wires $14a_2$ introduced from the outside.

The cathode is formed of a fine filament-like wire made of high melting point metal such as tungsten and coated with a coating material high in electron emission efficiency, and is stretched over and opposite to the pattern display sections 4 and control electrodes 5 and is fixed by filament supports 16, which are connected to cathode terminal lead-in wires $14a_3$ introduced from the outside.

The analog display section 3 consists of a plurality of dot anodes 18 shaped fluorescent display in the longitudinal direction and each having a fluorescent layer 17 thereon, pattern anodes 20 provided on the same surface as the dot anodes 18 and in the vicinity thereof and adapted to have patterns of characters and the like representing the number, quantity or the like of the fluorescent analog display given by the dot anodes 18 and each having a fluorescent layer 19 thereon, a control electrode 21 provided above and opposite to the dot anodes 18 and pattern anodes 20, and a cathode 22 stretched over the control electrode 21. In this embodiment, each of the dot anodes 18 is shown as square-shaped, but it may be of any desired shape such as circular or polygonal, as a matter of course.

The dot anodes 18 and the pattern anodes 20 are provided on the base plate 1 in a laminated manner with the wiring films 11 and the insulating film layer 12 therebetween. Each of the dot anodes 18 and pattern anodes 20 is electrically connected to the corresponding wiring film 11 through the corresponding connection hole 13 and further to a corresponding anode terminal lead-in wire 14$b_1$ introduced from the outside. If a plurality of the pattern anodes 20 are allowed to be simultaneously energized for display, the pattern anodes may be electrically connected with one another by a conductive film layer made of the same material as the anode 20, on the upper surface of the insulating film layer 12 on which the wiring film 11 or the pattern anodes 20 are provided and further to a single or a small number of anode lead-in wires 14*b* introduced from the outside. In addition, the pattern anodes 20 may be electrically connected to the pattern anodes 10 of the digital display section 2.

The central electrode 21 is arranged so that it may be positioned above and opposite to all the dot anodes 18 and pattern anodes 20 in common; controls or accelerates electrons emitted from the cathode 22 towards the dot anodes 18 and the pattern anodes 20; is formed for instance, of fine meshes so as to insure clear observation from the above; is fixed to the predetermined position through grid supports 23; and is electrically connected to a grid terminal lead-in wire 15$b_2$ introduced from the outside.

As in the case of the cathode 6 of the digital display section 2, the cathode 22 is preferably formed of a filament-like fine wire made of high melting-point metal and coated with a coating material high in thermion emission efficiency and is supported in tension above and opposite to the dot anodes 18, pattern anodes 20 and control electrode 21 by filament supports 27 connected to cathode terminal lead-in wires 14$b_3$ introduced from the outside.

Reference numeral 24 designates a cover plate framed with side portions as shown and being transparent at least at the portions positioned opposite to the digital display section 2 and analog display section 3. A casing 25 is formed of the base plate 1 and the cover plate 24 airtightly bonded together at the edge portions thereof with low melting-point frit glass or the like, and is adapted to contain the digital display section 2 and analog display section 3 provided on the base plate 1. Each of the terminal lead-in wires 14$a_1$, 14$a_2$, 14$a_3$, 14$b_1$, 14$b_2$ and 14$b_3$ connected to the respective anodes and electrodes provided on the base plate 1 are airtightly passed through the sealed portion 26 of the casing 25 between the base plate 1 and the cover plate 24. Thus, when power is supplied to the respective anodes and electrodes inside the casing 25 through the terminal lead-in wires introduced from the outside of the casing, the digital display section 2 and the analog display section 3 can be activated. In the above description, the cover plate 24 is shown as of a framed shape, but it may assume various other forms. For instance, in the case of a flat-shaped cover plate, it may be bonded with the base plate 1 with a spacer therebetween.

The display panel according to the embodiment of the present invention disclosed with reference to FIGS. 1 and 2 is constructed as mentioned above and therefore functions as follows:

First the cathodes 6 and 22 are energized through the cathode terminal lead-in wires 14$a_3$ and 14$b_3$ and thereby is heated to become a state ready for electron emission. Then voltage is applied between the cathode 6 and the pattern anodes 10, between the cathode 6 and the control electrode 5 (5*b*) positioned opposite to the pattern electrodes 10, between the cathode 22 and the pattern anodes 20, and between the cathode 22 and the control electrode 21. Thus, electrons are emitted from the cathodes 6 and 22 to collide with the anodes 10 and 20, respectively, and thereby light is emitted from the fluorescent layer 9 of each pattern anode 10 and the fluorescent layer 19 of each pattern anode 20 to display patterns such as figures and characters for indicating units, scales, symbols, etc. Next, pulse voltage is applied, with respect to the cathode 6, to the segment anodes 8 of the digital display section 2, and to the control electrodes 5*a* of the respective pattern sections or columns 4 while being successively synchronized therewith in a time-sharing manner. Thus the digital display section 2 can selectively and fluorescently display desired digital patterns such as figures and characters on its desired columns, successively. Meanwhile, in the analog display section 3, voltage is applied, with respect to the cathode 22, to the dot anodes 18 selectively and successively thereby to give a dot-shaped or bar-shaped fluorescent analog display.

The display panel according to one embodiment of the present invention is constructed as mentioned above with reference to FIGS. 1 and 2. In short, this display panel has a vacuum and air-tight casing 25 flat-shaped and formed of a base plate 1 and a cover plate 24. In the casing 25, a digital display section 2 and an analog display section 3 are provided on the same surface of the base plate 1. The digital display section 2 is adapted to make a multi-column digital display by utilizing excitation luminescence caused by bombardment of electrons onto fluorescent substance, and the analog display section 3 is adapted to give a moving dot-shaped analog display or a length-changing bar-shaped analog display. In addition, the display sections 2 and 3 are provided with pattern electrodes 10 and 20, respectively, which display patterns such as units, symbols and scales for the above digital and analog displays, respectively. (In FIG. 1, a velocity unit of Km/Hr is shown on the digital display section 2, and scale values are shown on the analog display section 3.) Thus, in this example, a velocity value can be indicated both digitally and analogically and, in addition, clearly by fluorescent display. Moreover, this display panel can be adapted to perform the above-mentioned digital and analog displays in the vicinity of each other and therefore can be made very compact. With these various advantages, this display panel can be advantageously used, for instance, as the front panel of the driver's seat of a vehicle such as an automobile.

In the above-mentioned example, shown is the display panel in which both the digital and analog displays involve velocity. However, the display panel of the present invention can be applied to a wide variety of displays other than those of velocity. For instance, it can display measured values of various electrical instruments, can digitally indicate time, and can analogically display the quantity of liquid, the position of a moving equipment, etc.

In the display panel shown in the above embodiment, both the digital and analog display sections are shown as provided with pattern anodes adapted to display units, symbols, scale values, etc. However, when pattern displays using such pattern anodes are not required, some other arrangements may be provided according to purposes as a matter of course.

Figure 3:
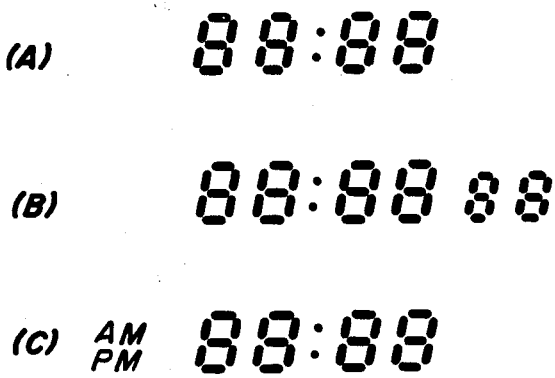
FIG. 3 shows examples of patterns for the digital display of time.

The digital display section of the display panel according to the above embodiment of the present invention is shown as adapted to display usual multi-digit figures. However, the function of the digital display section is not limited to such an example, as a matter of course. For instance, the digital display section can be arranged to show time (including date, day of the week, etc.) by application of a suitable pattern consisting of a combination of various figures, characters, etc. FIG. 3(A) shows a pattern which displays hours and minutes; FIG. 3(B) shows a pattern which displays hours, minutes, and seconds; and FIG. 3(C) shows a pattern which displays hours and minutes and has an additional pattern for indicating AM or PM. Moreover, the digital display section of the present invention can have a pattern which may selectively display at least two kinds of digital displays such as those of usual multi-digit figures and time according to purposes.

The digital display section 2 in the above embodiment has pattern display sections or columns 4 each composed of a plurality of segment anodes 8, and corresponding common segment anodes 8 of each column 4 are electrically connected to each other through wiring films 11 and are further connected to the outside power supply through the terminal lead-in wires $\mathbf{14}a_1$; and, in addition, it is provided with a control electrode 5 for each column 4. Furthermore, the external circuit for operating the above digital display section 2 is configured so that it may be suitable as a so-called dynamic driving circuit. Meanwhile, the analog display section 3 has dot anodes 18 provided side by side along a straight line connected separately to the respective terminal lead-in wires $\mathbf{14}b_1$ introduced from the outside; and it further has a common control electrode 21. The external circuit for operating the analog display section 3 is configured so that it may be suitable as a so-called static driving circuit. However, the present invention is not limited to the construction and combination mentioned above. For instance, the digital display section 2 may be so made that the segment anodes of each column are separately connected to the respective lead-in wires, that a single common control electrode is provided for all the columns, and that both the digital and analog display sections are operated by an external circuit according to a so-called static driving circuit. Meanwhile, the analog display section 3 may be so made that the dot anodes are grouped into a plurality of groups, that the corresponding dot anodes of the individual groups are connected in common and are connected to the respective terminal lead-in wires, that the control electrodes are separately provided for the individual groups, and that it is operated by an external circuit according to a so-called dynamic driving circuit as in the case of the digital display section 3. The combinations of the above-mentioned features may be suitably selected according to devices, external driving circuits, etc. as a matter of course.

The fluorescent substance layers 17 and 19 for use in the fluorescent display of the digital and analog display sections and those 9 and 19 additionally and selectively provided for the display of patterns such as units, symbols, scale values, etc. may be preferably made of fluorescent substance that emits light tinted with blue-green comfortable to see (e.g., fluorescent substance consisting of "ZnO:Zn"). However, two or more kinds of fluorescent substance layers may be provided for giving various kinds of colors. For instance, when used for indicating the speed of an automobile, the display panel of the present invention may be constructed so that it can give a clear visual warning to the driver when the speed of the car exceeds a predetermined value, e.g., 120 Km/Hr by using different fluorescent substance (for instance, fluorescent substance consisting of "ZnS:Ag" or "ZnS:Mn" which emits yellow or orange light) for dots, scale patterns, etc. provided for indicating a velocity value of 120 Km/Hr or more. Thus, according to the present invention, the display panel may have two or more kinds of fluorescent layers for emitting different kinds of light, and therefore can be used for a wide variety of uses.

According to the example mentioned above, the display panel has a pair of digital and analog display sections. However, the present invention is not limited to this example. For instance, the display panel may have two or more digital display sections which can display a multi-digit figure or time, as a matter of course. Thus, the display panel according to the present invention may compactly contain various kinds of fluorescent display sections and therefore can be more widely used.

With the above constructions, the display panel according to the present invention has the following advantages and effects:

(1) Since the digital and analog display sections are formed on the base plate in the flat-plate type casing which are formed of said base plate and the cover plate, the process for providing wiring films, common insulating layer, anodes of each display section, fluorescent substance layers, etc. in a laminated manner can be performed in the same step and therefore the display panel of the present invention can be produced very efficiently, simply, economically, and with high productivity and minimized quantities of materials and parts.

(2) The display panel according to the present invention has digital and analog display sections in the same casing, which display sections are of a fluorescent type easy to observe, and therefore can be made very compact compared with the conventional arrangement having a digital and analog display sections provided side by side. Thus the display panel of the present invention can be applied to a wide variety of purposes, such as panel display for vehicle, panel display for clock radio, and display panel for measuring instrument.

(3) As mentioned above, the digital display and analog display of the present invention utilize light emission from fluorescent substance layers caused by electron bombardment, and therefore the display panel of the present invention can be widely used for panel display of various electrical and measuring equipment in a dark space such as a vehicle.

(4) The display panel of the present invention whose digital display section can indicate time is characterized in that it can be used for panel display for various vehicles, various electronic equipment such as clock radio and can be accommodated in a very small space. Thus the equipment to which the display panel of the present invention is applied can be improved in function, appearance, economy, compactness, etc.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A flat plate type composition fluorescent display panel device comprising:

an insulating base plate;

a digital display section formed on a portion of the surface of said base plate, said digital display section having a plurality of segment anodes which selectively perform digital display of multi-column characters, figures, symbols and the like by using said segment anodes;

an analog display section formed on another portion of the surface of said base plate adjacent said digital display section, said analog display section having a plurality of dot anodes disposed along a line and a plurality of pattern anodes provided in the vicinity of the dot anodes and which selectively performs substantially analog dot-shaped and/or bar-shaped display by using said dot anodes to indicate the amplitude of an analog signal and the pattern anodes to represent the number, quantity and the like of the display given by the dot anodes, said dot anodes and said segment anodes formed in a common plane;

a fluorescent substance layer disposed on said segment anodes, said pattern anodes and said dot anodes for emitting light when bombarded with electrons;

cathode electrode means suspended over said segment anodes, said pattern anodes and said dot anodes for emitting electrons which bombard said fluorescent substance layer;

a wiring film layer disposed on the surface of said base plate between said base plate and said display sections for making electrical connection to said dot anodes, said pattern anodes, and said segment anodes;

an insulating layer disposed between said wiring film layer and said dot anodes, said pattern anodes, and said segment anodes for maintaining electrical isolation between adjacent dot anodes, adjacent pattern anodes and adjacent segment anodes;

a light transparent cover plate attached to said base plate for external viewing of said analog display and said digital display; and an evacuated space between said cover plate and said base plate, said evacuated space enabling electrons emitted from said cathode electrode means to travel relatively unimpeded to said segment anodes, said pattern anodes, and said dot anodes respectively;

whereby said wiring film layer, said insulating layer, said dot anodes, said pattern anodes, and said segment anodes, and said fluorescent layer are produced in a laminated manner, thereby providing an integrated analog and digital fluorescent display panel device.

2. The device as set forth in claim 1, wherein said digital display section has patterns adapted to exclusively or selectively display time.

3. The device as set forth in claim 1, wherein at least two digital display sections adapted to display multi-column figures and/or time are provided.

4. The device as set forth in claim 1, wherein said device comprises at least two kinds of said fluorescent substance layers different in fluorescent color so that said display sections can display partially different fluorescent colors.

* * * * *